US012492881B1

(12) United States Patent
Wei

(10) Patent No.: US 12,492,881 B1
(45) Date of Patent: Dec. 9, 2025

(54) GAS CYLINDER PIERCING MECHANISM FOR AN AIRGUN

(71) Applicant: WinGun Technology Co., Ltd., New Taipei (TW)

(72) Inventor: Ho-Sheng Wei, New Taipei (TW)

(73) Assignee: WinGun Technology Co., Ltd., New Taipei (TW)

( * ) Notice: Subject to any disclaimer, the term of this patent is extended or adjusted under 35 U.S.C. 154(b) by 0 days.

(21) Appl. No.: 19/256,156

(22) Filed: Jul. 1, 2025

(30) Foreign Application Priority Data

Mar. 14, 2025 (TW) ..... 114202589

(51) Int. Cl.
*F41B 11/62* (2013.01)
*F41B 11/70* (2013.01)

(52) U.S. Cl.
CPC ..... *F41B 11/62* (2013.01); *F41B 11/70* (2013.01)

(58) Field of Classification Search
CPC ..... F41B 11/62; F41B 11/723; F41B 11/57; F41B 11/721; F41B 11/64; F41B 11/71; F41B 11/70; F41B 11/724; F41B 11/54; F41B 11/73; F41B 11/00
USPC ..... 124/73, 70, 67, 76, 69, 77, 37, 58, 71
See application file for complete search history.

(56) References Cited

U.S. PATENT DOCUMENTS 9,335,116 B1 * 5/2016 Wei ..... F41A 9/68
10,132,592 B1 * 11/2018 Wei ..... F41A 19/02
10,352,647 B1 * 7/2019 Wei ..... F41B 11/62
10,690,438 B1 * 6/2020 Wei ..... F41B 11/54
10,712,120 B1 * 7/2020 Wei ..... F41B 11/89
10,852,098 B1 * 12/2020 Wei ..... F41C 23/16
11,609,063 B1 * 3/2023 Wei ..... F41B 11/64
11,680,770 B2 * 6/2023 Buys ..... F41B 11/723 124/74
12,276,475 B1 * 4/2025 Wei ..... F41B 11/89
12,379,182 B2 * 8/2025 Pasquale ..... F41B 11/62
12,392,577 B1 * 8/2025 Wei ..... F41B 11/723
2006/0191523 A1 * 8/2006 Paletz ..... F41B 11/642 124/67
2011/0036338 A1 * 2/2011 Wei ..... F41B 11/55 124/80
2011/0131882 A1 * 6/2011 Wei ..... F41B 11/62 49/142
2014/0096756 A1 * 4/2014 Wei ..... F41B 11/62 124/73
2017/0268848 A1 * 9/2017 Wei ..... F41B 11/89
(Continued)

*Primary Examiner* — Michael D David
(74) *Attorney, Agent, or Firm* — Eric B. Fugett; Mark A. Pitchford; Pitchford Fugett, PLLC

(57) ABSTRACT

A gas cylinder piercing mechanism for an airgun includes a housing, a piercing needle, and a trigger assembly. The housing includes an expansion channel, a gas supply channel, and a receiving space for receiving a cylinder of a compressed gas. The trigger assembly, connected to the housing, drives the piercing needle in the expansion channel to pierce the gas cylinder. The piercing needle includes a head portion having an internal gas passage and an oblique cutting surface. The gas passage includes a gas inlet in the oblique cutting surface and a gas outlet spaced from the oblique cutting surface that links the gas passage to the gas supply channel via the expansion channel so that compressed gas flows from the cylinder into the expansion channel and on to the gas supply channel upon operation of the trigger.

19 Claims, 9 Drawing Sheets

(56) References Cited

U.S. PATENT DOCUMENTS

| | | | | |
|---|---|---|---|---|
| 2018/0156566 | A1* | 6/2018 | Wei | F41B 11/70 |
| 2021/0389079 | A1* | 12/2021 | Wei | F41B 11/89 |

* cited by examiner

GAS CYLINDER PIERCING MECHANISM FOR AN AIRGUN

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present disclosure relates to a piercing of gas cylinders, and more particularly, to a gas cylinder piercing devices for airguns.

Gas cylinder piercing devices for airguns primarily consist of a mechanism where a gas cylinder is housed and equipped with a piercing needle. The user operates the device by forcefully pushing the piercing needle to pierce the cylinder, allowing the compressed gas contained within to be expelled through the pierced opening for utilization.

However, the heads of conventional piercing needles require the needle to advance and pierce the cylinder before retracting to reveal the pierced opening, thereby facilitating the release of compressed gas from the cylinder. Consequently, this affects the firing speed of the first projectile, making it slower than the firing speed of subsequent projectiles (below average firing speed). Additionally, because the entire needle head is traditionally cylindrical-shaped, the subsequent insertion process after initial piercing forces the user to exert considerable effort from the start to the end of the subsequent trigger pull to overcome the friction between the needle and the cylinder. This has long been disliked and criticized by users.

Accordingly, there exists a need for improvements in gas cylinder piercing mechanisms for airguns.

SUMMARY OF THE DISCLOSURE

An objective of this application is to provide a gas cylinder piercing mechanism for an airgun that allows a compressed gas within a gas cylinder to instantly flow into a gas supply channel for use in expelling a projectile at the moment of piercing, and also allows a trigger assembly to require less effort to operate during subsequent pulls (i.e., operations) of the trigger.

In order to achieve the above objectives, the present application provides a gas cylinder piercing mechanism for an airgun, comprising: a housing including a gas supply channel, an expansion channel in fluid communication with the gas supply channel, and a receiving space in which a cylinder of compressed gas is receivable in fluid communication with the expansion channel; a movable piercing needle in the expansion channel defining an internal gas passage configured to direct the compressed gas from the cylinder into the expansion channel such that compressed gas flows to the gas supply channel when the piercing needle pierces the cylinder; and a trigger assembly rotatably connected to the housing and configured to drive the piercing needle to pierce the gas cylinder when the trigger assembly is operated and the cylinder is received in the receiving space.

Compared with traditional piercing mechanisms, the present invention provides a number of benefits. For example, since the needle head itself is provided with a gas passage wherein the gas inlet of the gas passage is located at the free end of the needle head, and the gas outlet of the gas passage is fluidly communicated to the gas supply channel, the firing speed of the first projectile is dramatically increased relative to conventional gas cylinder piercing devices. Furthermore, as the needle head is designed as a triangular column, the gas outlet can be placed on the bottom surface of the triangular column, and the gas from the cylinder can be immediately provided to the gas supply channel through the gas outlet. Moreover, because the piercing needle is designed to retract from the gas cylinder after each trigger operation (i.e., pull of the trigger) and at least partially reenter the cylinder upon each subsequent trigger operation (i.e., trigger pull), subsequent trigger operations after initial piercing of the gas cylinder are easier than the first. Put another way, the piercing mechanism provides a labor saving benefit in that subsequent trigger pulls require less effort to operate the trigger. Reentry of the cylinder by the piercing needle also ensures that the flow of gas from the cylinder to the gas supply channel is unimpeded by any debris which may clog the cylinder at the piercing site.

Numerous other objects, advantages and features of the present disclosure will be readily apparent to those of skill in the art upon a review of the following drawings and description of exemplary embodiments.

BRIEF DESCRIPTION OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
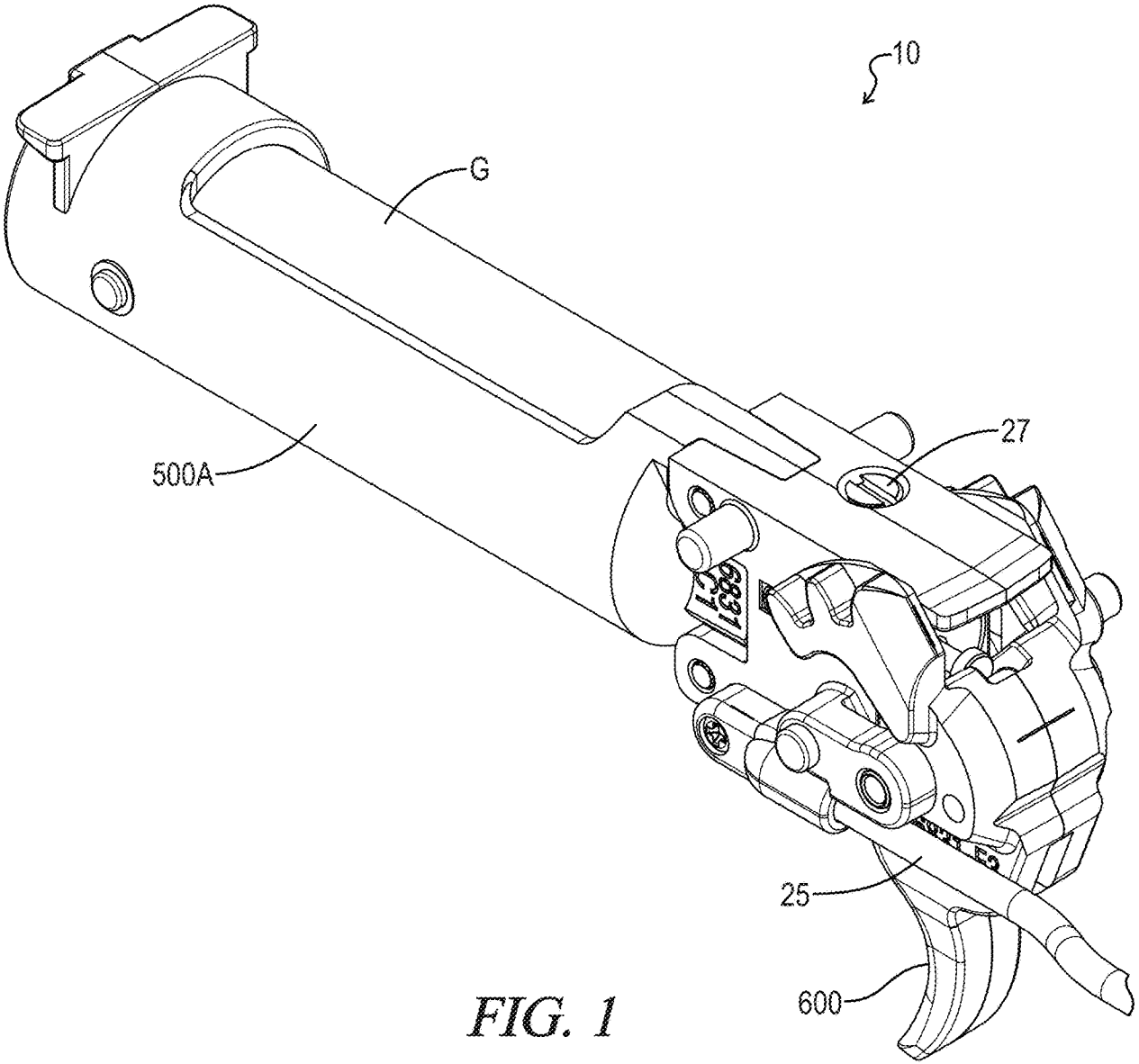
FIG. 1 is an elevated rear left side perspective view of an embodiment of a gas cylinder piercing mechanism for an airgun constructed in accordance with the present invention.

As described herein, an "upright" position is considered to be the position of apparatus components while in proper operation or in a natural resting position as described and shown herein, for example, in FIG. 1. The upright firing position of an airgun is a generally level firing position. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

As used herein, the terms "front" and "forward" means in a direction extending toward the muzzle of the airgun. In some cases, the term "forward" can also mean forward beyond the muzzle of the airgun. The terms "aft" and "rear" means in a direction extending away from the muzzle of the airgun toward a rear end of the airgun. In some cases, the term "rearward" can also mean rearward beyond the rear end of the airgun.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

The term "substantially" as used herein and unless otherwise specifically defined elsewhere means what is considered normal or possible within the limits of applicable industry-accepted manufacturing practices and tolerances.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Referring now to FIGS. 1-10, there is shown an exemplar embodiment of a gas cylinder piercing mechanism 10 for an airgun constructed in accordance with the principles of the present invention. The gas cylinder piercing mechanism 10 includes a cylinder placement structure (i.e., a housing) 500A, a trigger assembly 600, a piercing needle 100, and an abutting member (i.e., an end cap) 700. The gas cylinder piercing mechanism 10 is configured to drive the piercing needle 100 to pierce a cylinder G containing a compressed gas upon operation (i.e., pulling) of the trigger assembly 600.

Figure 2:
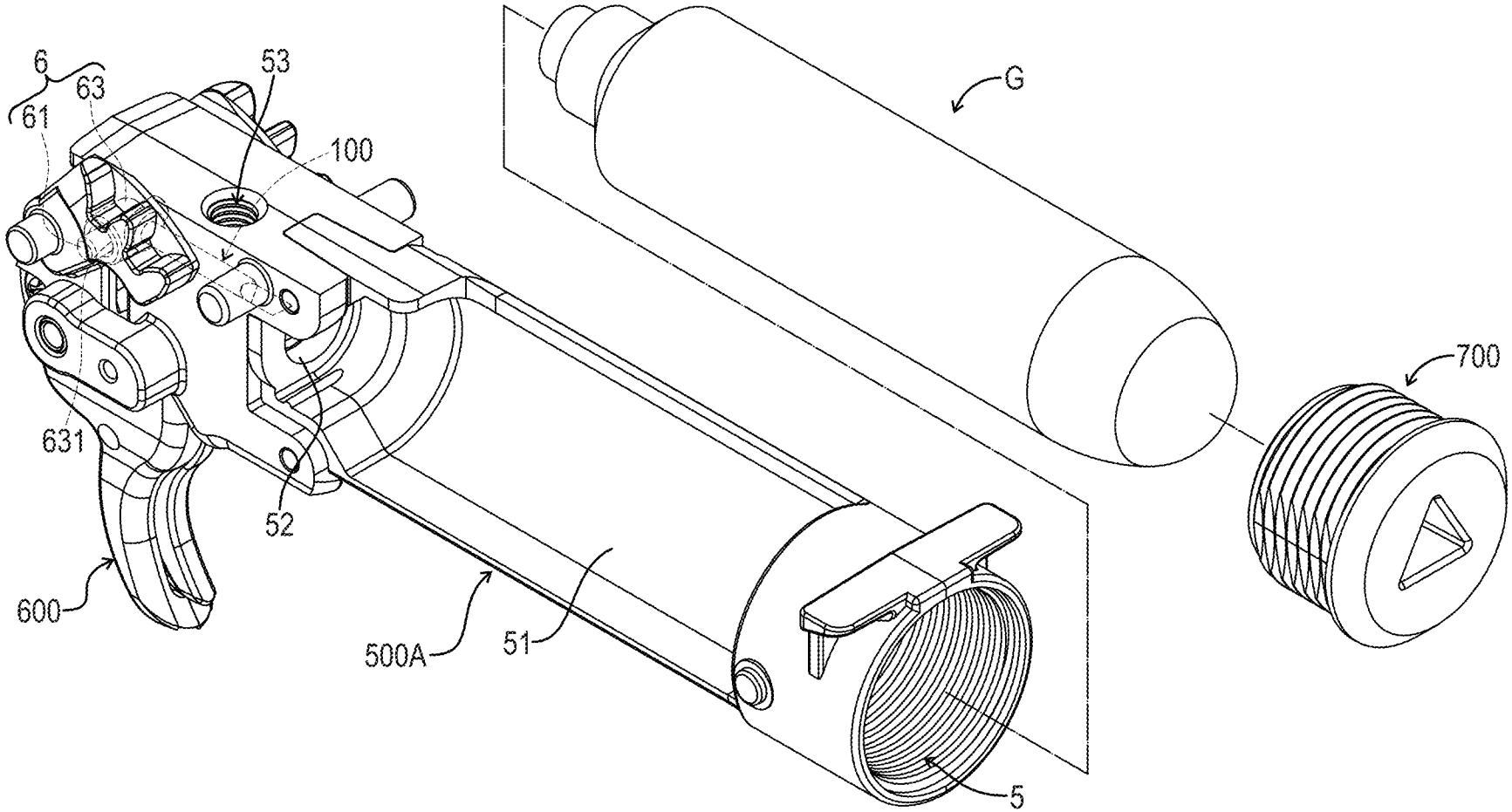
FIG. 2 is a partially exploded elevated front right side perspective view of the gas cylinder piercing mechanism of FIG. 1. The set screw and gas supply line are omitted for clarity.
Figure 3:
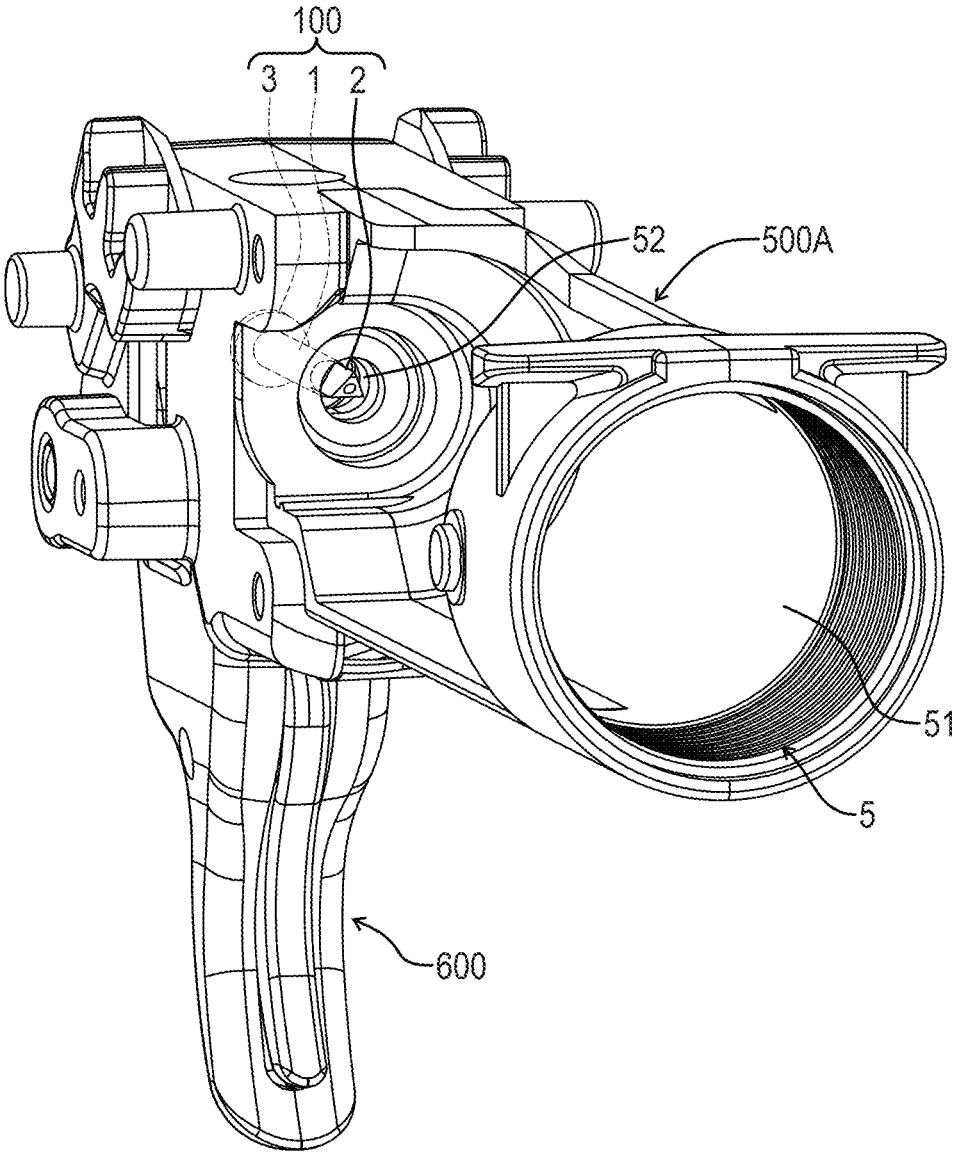
FIG. 3 is a front perspective view of the gas cylinder piercing mechanism of FIG. 1 with the gas cylinder omitted for clarity.

The cylinder placement structure or housing 500A can be any structure that can receive the cylinder G and employ the piercing needle 100 to pierce the cylinder G. The cylinder placement structure or housing 500A is not limited to a particular structure. As shown in FIGS. 1-2, the exemplar embodiment is illustrated using a less-lethal airgun as an example equipped with the gas cylinder piercing mechanism 10.

The cylinder placement structure or housing 500A includes a receiving space 51, which can be a completely or partially enclosed interior space of the cylinder placement structure or housing 500A, along with an expansion channel 52 and a gas supply channel 53. The gas supply channel 53 is fluidly connected at one end to a gas supply line 25 (i.e., a tube) that directs compressed gas to a valve seat (not shown) for use in powering an airgun. The other end of gas supply channel 53 is releasably sealed by a set screw 27 and an O-ring (unlabeled). The expansion channel 52 and the gas supply channel 53 intersect and fluidly communicate with each other in the cylinder placement structure 500A, as exemplified in FIGS. 8-9. One end of the receiving space 51 is connected to and fluidly communicates with one end of the expansion channel 52. The expansion channel 52 and the cylindrical-shaped receiving space 51 are aligned along the same straight line (i.e., a longitudinal axis), and may be coaxially arranged with each other. The cylinder G is detachably received in the receiving space 51.

One end of the cylinder placement structure or housing 500A opposite the expansion channel 52 is configured to securely yet releasably receive the abutting member 700. The end of the housing can be a threaded socket (but is not limited to this) located at the other end of the receiving space 51 from expansion channel 52. This arrangement allows for the abutting member 700, which may be a threaded stud (but is not limited to this), to be adjustably assembled in the open end of the receiving space 51. In addition to that, referring to FIG. 7, the abutting member 700 is screwed into the open end of the receiving space to adjust the abutting member 700 to tightly abut against a tail end of the cylinder G, thereby preventing the cylinder G from displacing.

The trigger assembly 600 is rotatably connected to the cylinder placement structure or housing 500A. The trigger assembly 600 includes a pushing part 6 which is configured to push the piercing needle 100 longitudinally forward. In detail, the pushing part 6 includes a roller 63, and specifically further includes a shaft 61. The roller 63 is provided with a shaft hole 631 and includes a circumferential surface 633 surrounding the shaft hole 631, so that the roller 63 may sheathe the shaft 61 with the shaft hole 631 (for example, the roller 63 is rotatably mounted onto the shaft 61). It should be noted that the roller 63 may be a rubber wheel, but the present application is not limited in this regard.

Figure 4:
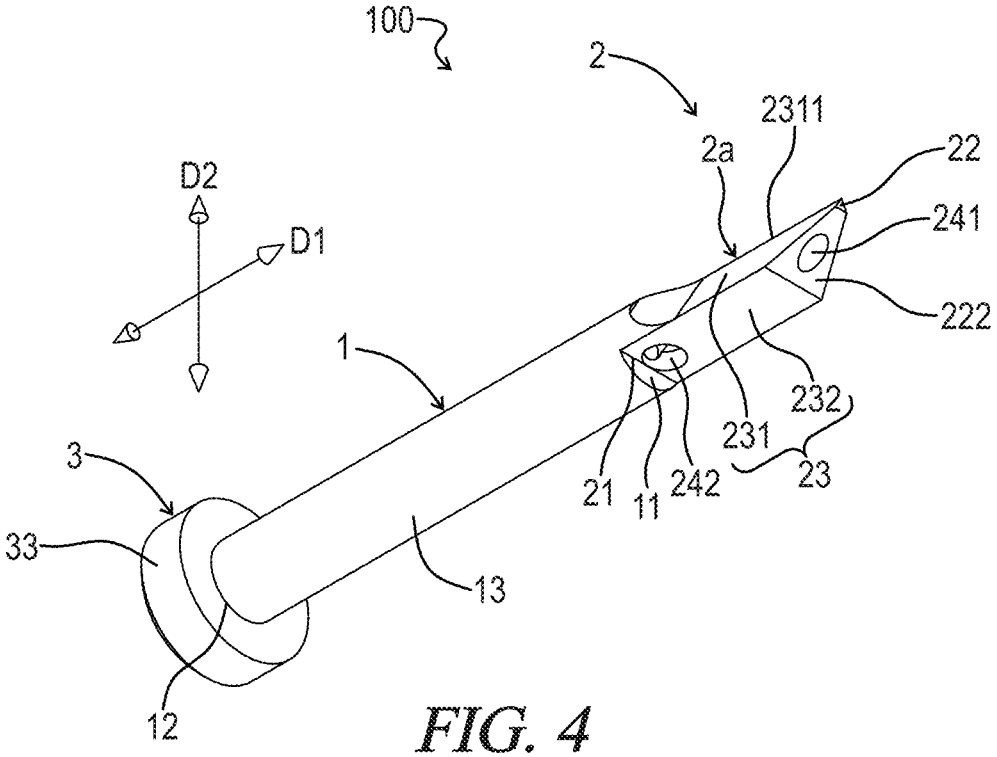
FIG. 4 is a bottom perspective view of the piercing needle of the gas cylinder piercing mechanism of FIG. 1.
Figure 5:
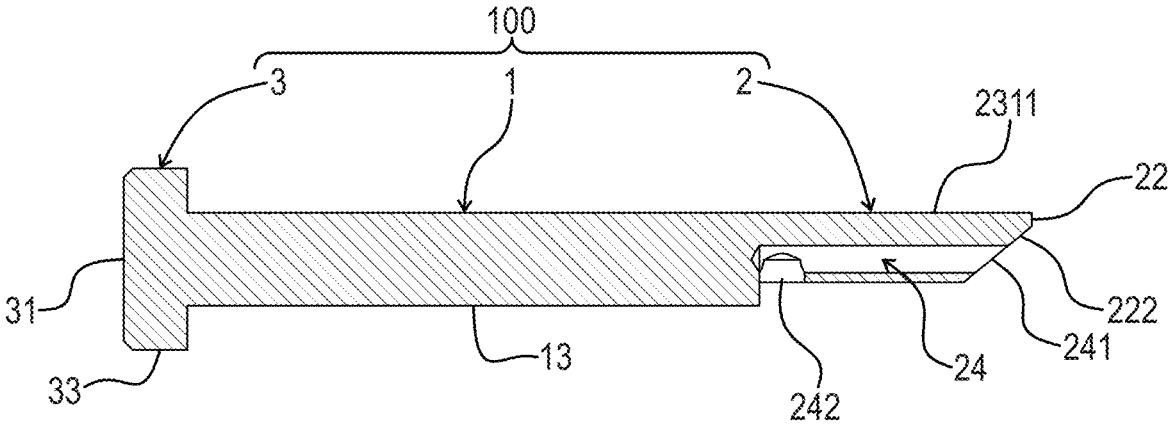
FIG. 5 is a schematic cross-sectional view of the piercing needle of FIG. 3.
Figure 6:
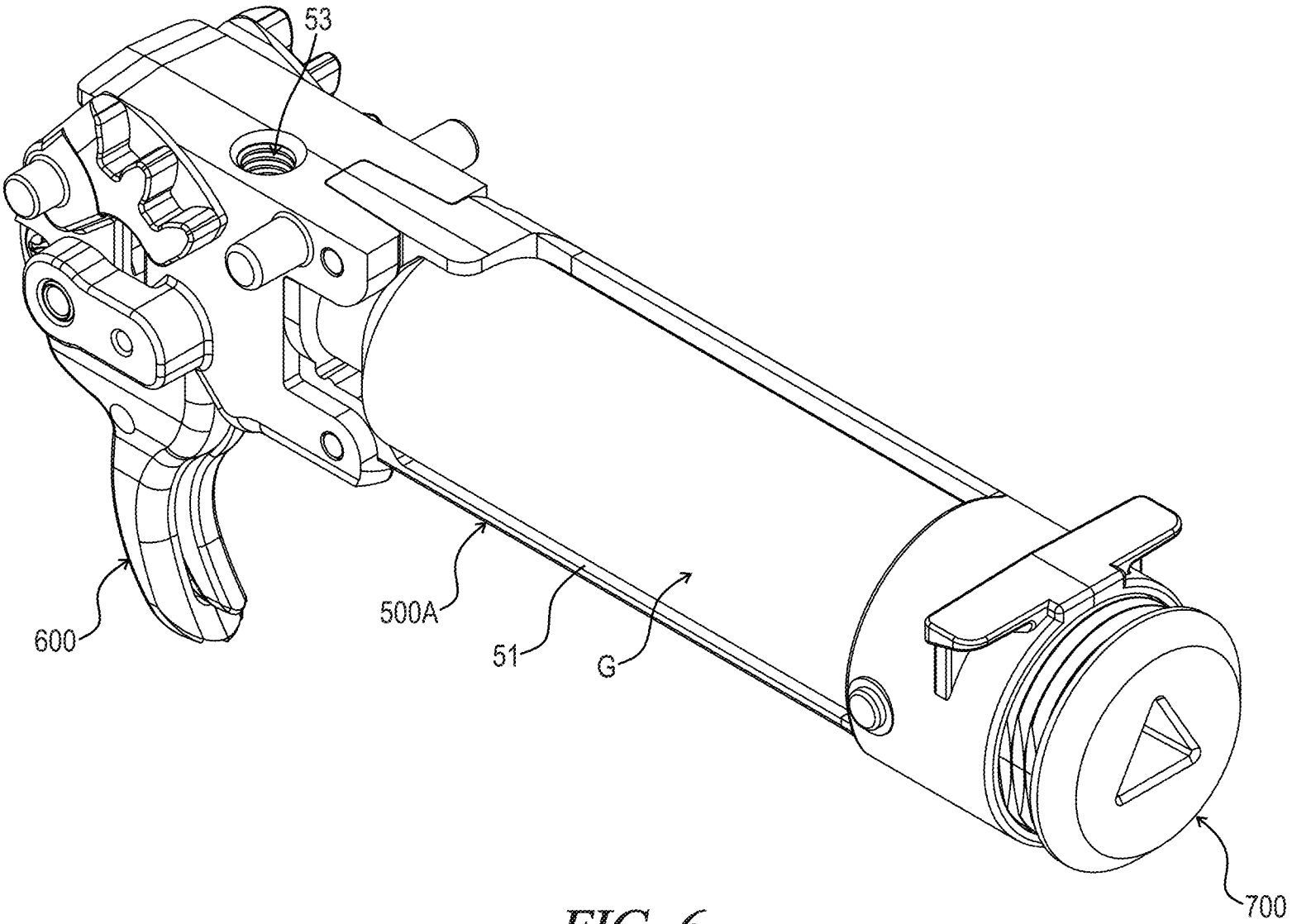
FIG. 6 is a perspective assembled view of the gas cylinder piercing mechanism of FIG. 2.

The piercing needle 100 is inserted into the cylinder placement structure 500A via the expansion channel 52, and can include: a main body 1, a needle head (head portion) 2, and a base 3. The main body 1 may be an object of any shape, such as a long rod with an outer peripheral surface 13, and as shown in FIG. 4, the main body 1 is a cylindrical rod. The main body 1 includes a first end face 11 and a second end face 12 that are opposite to each other. In addition, as shown in FIG. 4, the main body 1 defines an axial direction D1 and a radial direction D2 that are perpendicular to each other.

Figure 7:
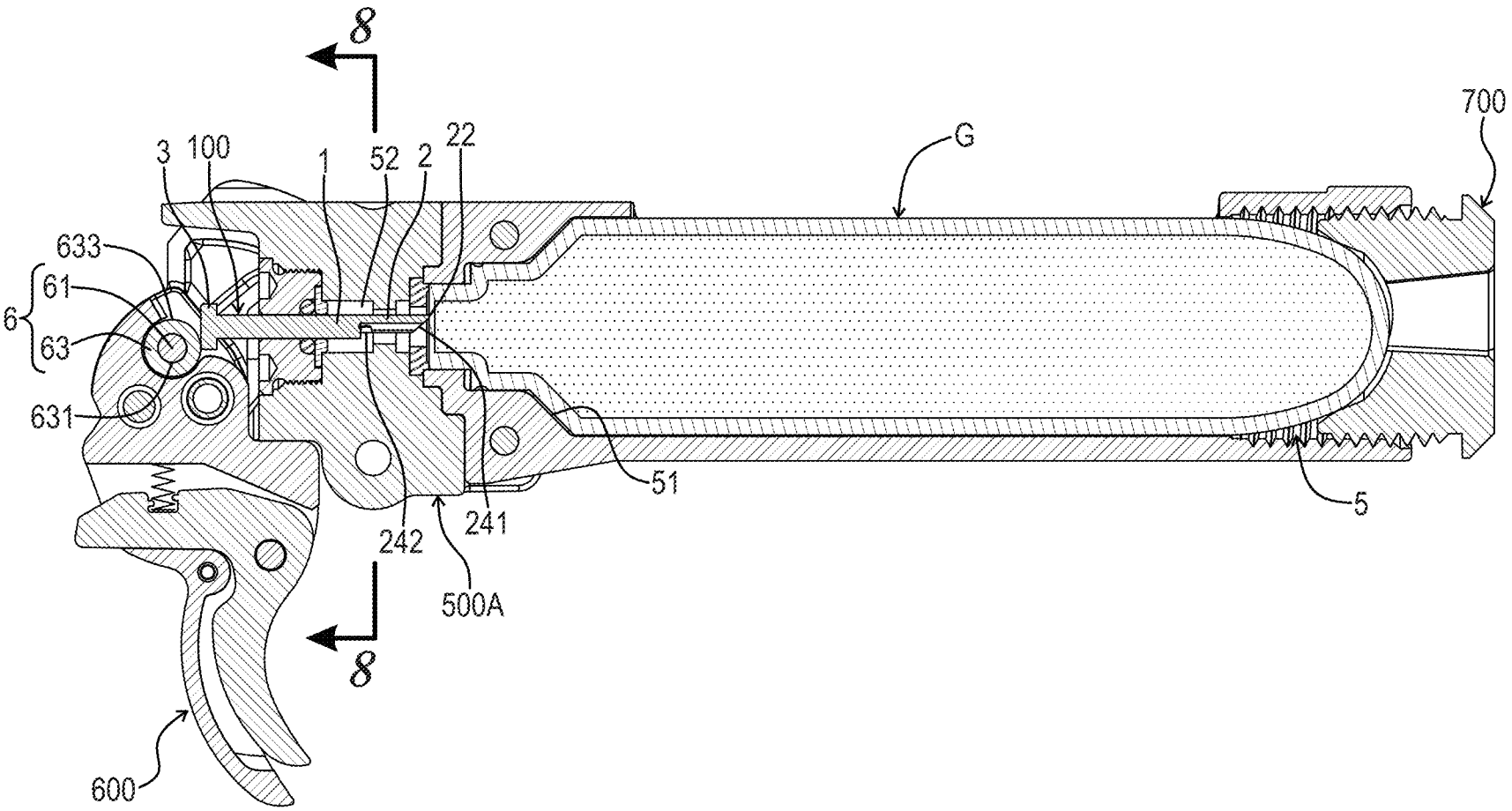
FIG. 7 is a schematic cross-sectional view of the gas cylinder piercing mechanism of FIG. 6 before piercing.
Figure 8:
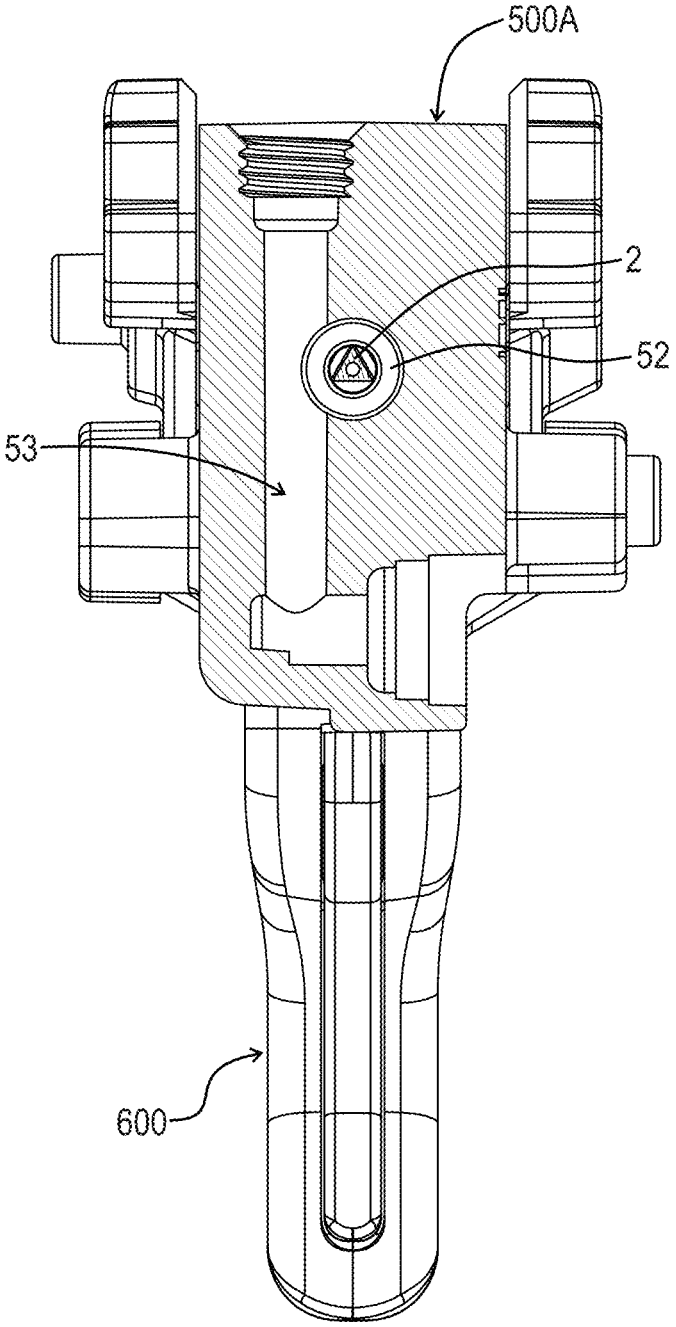
FIG. 8 is a schematic perspective cross-sectional view of the gas cylinder piercing mechanism of FIG. 6 taken along line 8-8.
Figure 9:
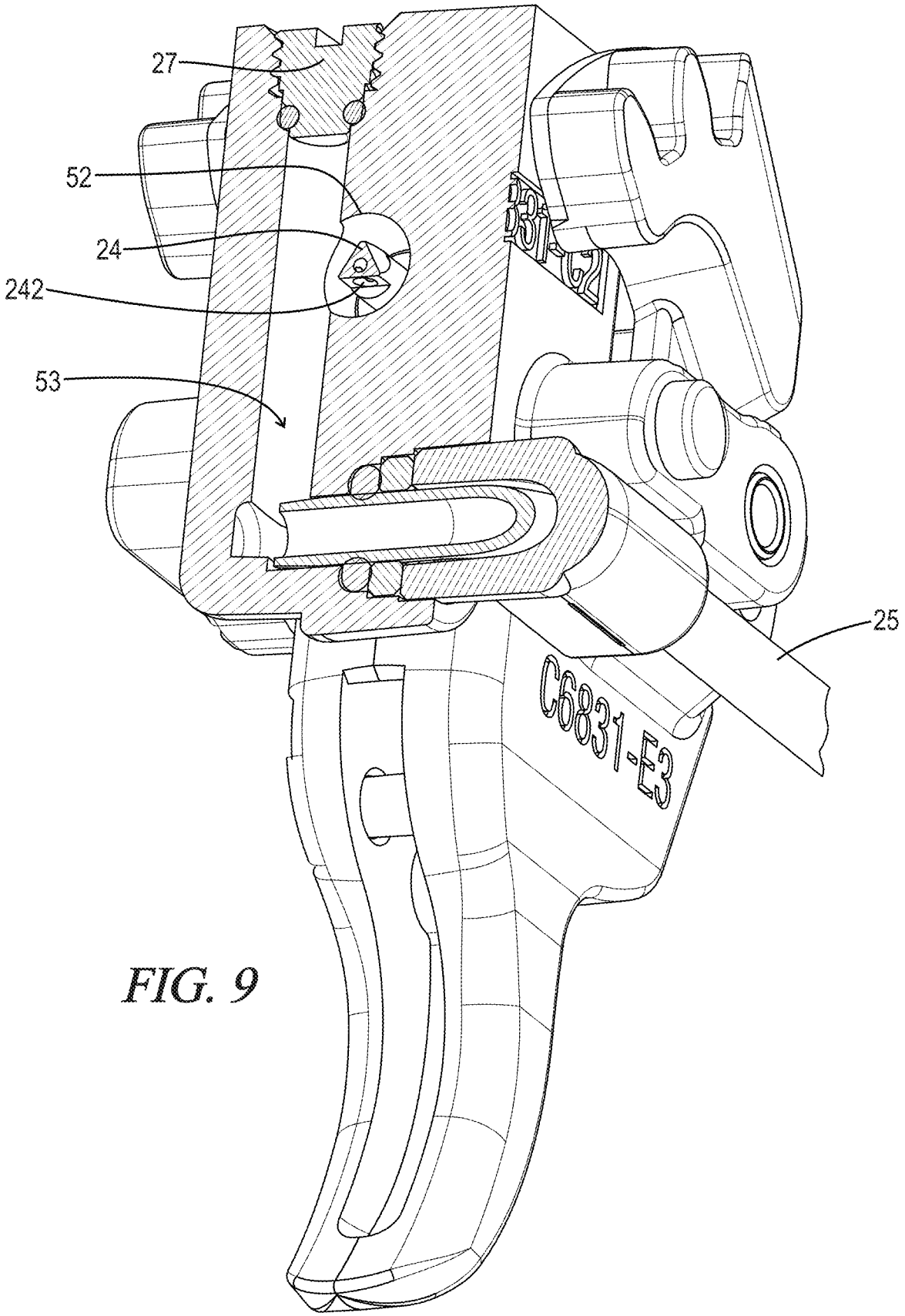
FIG. 9 is a perspective view of the objects of FIG. 8 with the omitted set screw and gas supply line shown for clarity.

The needle head 2 may be a triangular column 2*a* with a non-circular cross section (such as triangular cross-section) and is provided with an internal gas passage 24 that extends through the entire length of the needle head 2. The needle head 2 includes a connecting end 21 and a free end 22, along with an outer wall surface 23 encircling the gas passage 24. The needle head 2, aligned along the axial direction D1, is integrally connected to the first end face 11 of the main body 1 at the connecting end 21 of the needle head 2. The free end 22, positioned away from the main body 1, is obliquely cut to form an oblique cutting surface 222. This configuration allows the gas passage 24 to form a gas inlet 241 on the oblique cutting surface 222, and a gas outlet 242 on the outer wall surface 23 corresponding to the connecting end 21. As shown in FIGS. 7-9, the gas outlet 242 is positioned within the expansion channel 52, so that the gas outlet 242 may indirectly communicate with the gas supply channel 53 through the expansion channel 52 as best shown in FIGS. 7 and 9. In other words, the gas passage 24 is formed in the needle head 2 along the axial direction D1, and the gas inlet 241 is formed along the axial direction D1, and the gas outlet 242 is formed along the radial direction D2.

In some embodiments, the needle head 2 is a triangular column 2*a* with an isosceles triangular cross-section. The oblique cutting surface 222 at one end (free end 22) of the triangular column 2*a* has an oblique cutting angle of approximately 45 degrees to 60 degrees. The aforementioned outer wall surface 23 of the triangular column 2*a* includes a bottom face 232 and two side faces 231 arranged in an encircling manner, and the gas outlet 242 is formed on one of these three faces (for example: the bottom face 232).

In addition, the two side faces 231 define an adjacent edge 2311 therebetween. The adjacent edge 2311 is flush with the aforementioned outer peripheral surface 13 of the main body 1. Moreover, both the bottom face 232 and the two side faces 231 are recessed relative to the outer peripheral surface 13 in a translation manner.

The base 3 is integrally connected to the second end face 12 of the main body 1. The base 3 is provided with a force-receiving plane 31 in a planar shape, and the base 3 also includes an outer peripheral edge 33. The base 3 may be an object of any shape. In some embodiments, the outer peripheral edge 33 of the base 3 extends outward relative to the outer peripheral surface 13, for example, it may be expanded into a disc shape as shown in the drawings; however, the present application is not limited to this configuration.

Figure 10:
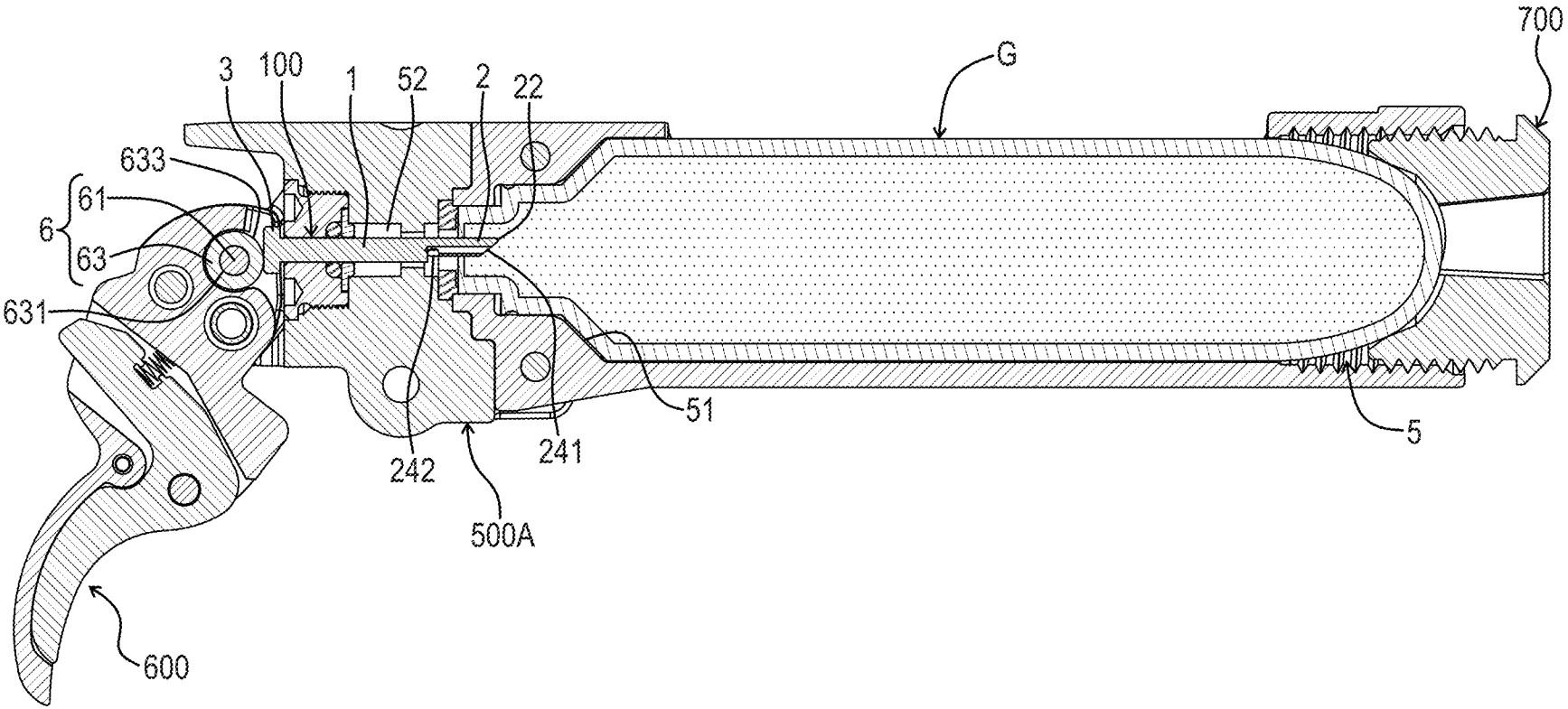
FIG. 10 is a schematic cross-sectional view of the gas cylinder piercing mechanism of FIG. 6 after piercing.

As shown in FIGS. 7 and 10, when the user actuates the trigger assembly 600, the circumferential surface 633 of the roller 63 presses against the force-receiving plane 31 or rear end of the base 3. This action propels the piercing needle 100 along the axial direction D1 to pierce the cylinder G. At the moment of piercing, the compressed gas within the cylinder G initially enters the gas passage 24 through the gas inlet 241 and subsequently flows from the gas outlet 242 into the expansion channel 52 and then the gas supply channel 53 of the cylinder placement structure or housing 500A which in turn supplies the compressed gas to the gas supply line 25 and the valve seat of the airgun for use in propelling a projectile out of a barrel or similar structure of the airgun.

Consequently, since the needle head 2 of the piercing needle 100 is equipped with the gas passage 24, and the gas inlet 241 is located at its free end 22, the gas inside the cylinder G may be swiftly directed into the gas inlet 241 the instant the needle head 2 pierces the cylinder G. Moreover, because the gas outlet 242 of the gas passage 24 is positioned at the tail end (connecting end 21) of the needle head 2 and is indirectly connected to the gas supply channel 53, the gas from the cylinder G is instantly supplied to the airgun through the gas supply channel 53 for use in launching projectiles. This setup allows the firing speed of the first projectile to be practically immediate and unaffected by any delay in system pressurization traditionally associated with initial piercing.

Furthermore, the needle head 2 is designed as the aforementioned triangular column 2*a*, and the free end 22 of the triangular column 2*a* is obliquely cut to form the oblique cutting surface 222 and a sharp shape at the adjacent edge 2311 (as seen in FIG. 4). Thus, the gas outlet 242 is suitable to be placed on the bottom face 232, and the gas from the cylinder G can be immediately provided to the gas supply channel 53 through the gas outlet 242. The shape of the needle head 2 also enables the piercing needle 100 to be automatically retracted from the cylinder G upon piercing as compressed gas released from the cylinder G will apply a rearward force against the forward surface 222 of the needle head 2 sufficient to push the piercing needle 100 longitudinally backward (i.e., rearward) into the resting position depicted in FIG. 7 when a user releases the trigger assembly 600. In this way, the piercing needle 100 is configured to retract from the cylinder G when the trigger assembly 600 is released after being operated. Contact between the base 3 of the piercing needle 100 with the circumferential surface 633 of the roller 63 prevents the compressed gas from pushing the piercing needle 100 rearwardly out of the housing 500A. When the trigger assembly 600 is released after initial piercing, the compressed gas will continue to flow from the cylinder G to the expansion channel around the piercing needle 100.

Subsequent operation (i.e., pulls) of the trigger assembly 600 are easier than the first because the piercing needle 100 will encounter dramatically less resistance or friction when at least partially reentering the original hole made in the cylinder G upon initial piercing. In this way, the piercing mechanism 10 provides a labor saving benefit in that follow-up trigger pulls require less effort to operate the trigger assembly 600. During subsequent trigger pulls, the compressed gas can flow from the cylinder G to the expansion channel 53 through the gas passage 24 as well as around the piercing needle 100.

Furthermore, because the outer peripheral edge 33 of the base 3 extends outward relative to the outer peripheral surface 13, the pushing force from the trigger assembly 600 remains effective even if there is a slight angular deviation in the path of the piercing needle 100 during piercing. Additionally, the trigger assembly 600 employs the roller 63 (especially its circumferential surface 633) to push the piercing needle 100. This method, which does not directly engage corresponding parts of the trigger assembly 600 for pushing, helps prevent wear and damage to the corresponding parts of the trigger assembly 600.

As will be recognized by those of ordinary skill in the art, numerous sealing members (unnumbered) having different shapes and sizes, including O-rings, gaskets, gasket sleeves, and washers, can be disposed at different locations within the gas cylinder piercing mechanism 10 of the present invention to seal the flow path of the compressed gas from the cylinder G to the gas supply line 25.

In alternative embodiments not illustrated in the drawings, the piercing needle 100 of this application may be configured without the base 3, and the trigger assembly 600 utilizes its pushing part 6 to apply force directly to the second end face 12 of the piercing needle 100, thereby driving the piercing needle 100 to pierce the cylinder G.

In summary, the cylinder piercing device for an airgun described in this application may indeed fulfill the intended use purpose and achieve the desired effect, effectively addressing the shortcomings of the related art.

The above description is only a preferred and feasible embodiment of this application, and is not intended to limit the patent scope of this application. Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A gas cylinder piercing mechanism for an airgun, comprising:

a housing comprising a gas supply channel, an expansion channel in fluid communication with the gas supply channel, and a receiving space in which a cylinder of a compressed gas is receivable in fluid communication with the expansion channel;

a piercing needle movably disposed in the expansion channel and defining an internal gas passage configured to direct the compressed gas from the cylinder into the expansion channel such that the compressed gas flows to the gas supply channel when the piercing needle pierces the cylinder; and a trigger assembly rotatably connected to the housing and configured to drive the piercing needle to pierce the cylinder when the trigger assembly is operated and the cylinder is received in the receiving space.

2. The gas cylinder piercing mechanism of claim 1, wherein the piercing needle is configured to retract from the cylinder when the trigger assembly is released after being operated.

3. The gas cylinder piercing mechanism of claim 2, wherein the compressed gas initially flows from the cylinder to the expansion channel through the piercing needle upon piercing.

4. The gas cylinder piercing mechanism of claim 1, wherein the compressed gas flows from the cylinder to the expansion channel around the piercing needle after piercing when the trigger assembly is released.

5. The gas cylinder piercing mechanism of claim 2, wherein:

the piercing needle comprises a head portion configured to pierce the cylinder; and the internal gas passage extends at least partially through the head portion.

6. The gas cylinder piercing mechanism of claim 5, wherein:

the head portion defines an oblique cutting surface; and the internal gas passage comprises a gas inlet defined through the oblique cutting surface and a gas outlet defined through an outer surface of the head portion spaced from the oblique cutting surface.

7. The gas cylinder piercing mechanism of claim 5, wherein:

the head portion comprises a non-circular cross section.

8. The gas cylinder piercing mechanism of claim 5, wherein:

the head portion is a triangular column.

9. The gas cylinder piercing mechanism of claim 2, wherein:

the piercing needle comprises a main body and a head portion;

the main body comprises an outer peripheral surface;

the head portion is a triangular column with an isosceles triangular cross-section, and comprises a bottom face and two side faces; and the bottom face and the two side faces are all recessed from the outer peripheral surface.

10. The gas cylinder piercing mechanism of claim 9, wherein:

the internal gas passage extends at least partially through the head portion and comprises a gas outlet defined through the bottom face.

11. The gas cylinder piercing mechanism of claim 9, wherein:

the piercing needle defines an adjacent edge disposed between the two side faces; and the adjacent edge is flush with the outer peripheral surface.

12. The gas cylinder piercing mechanism of claim 2, wherein:

the piercing needle defines a longitudinal axis;

the internal gas passage extends axially through at least a portion of the piercing needle from a gas inlet toward a gas outlet spaced from the gas inlet; and the gas outlet extends through the piercing needle radially away from the longitudinal axis.

13. The gas cylinder piercing mechanism of claim 2, wherein:

the piercing needle comprises a head portion, a main body, and a base; and a diameter of the base is greater than a diameter of the head portion and a diameter of the main body.

14. The gas cylinder piercing mechanism of claim 2, wherein:

the trigger assembly comprises a part configured to push against the piercing needle when the trigger assembly is operated.

15. The gas cylinder piercing mechanism of claim 2, wherein:

the trigger assembly comprises a part configured to push against a rear end of the piercing needle when the trigger assembly is operated.

16. The gas cylinder piercing mechanism of claim 15, wherein:

the part comprises a roller having a circumferential surface configured to push against the rear end of the piercing needle.

17. The gas cylinder piercing mechanism of claim 15, wherein:

the part is configured to limit rearward movement of the piercing needle when the piercing needle is retracted from the from the cylinder.

18. A gas cylinder piercing mechanism for an airgun, comprising:

a housing comprising a gas supply channel, an expansion channel in fluid communication with the gas supply channel, and a receiving space in which a cylinder of a compressed gas is receivable in fluid communication with the expansion channel;

a piercing needle movably disposed in the expansion channel and defining an internal gas passage configured to direct the compressed gas from the cylinder into the expansion channel such that the compressed gas flows to the gas supply channel when the piercing needle pierces the cylinder; and a trigger assembly rotatably connected to the housing and configured to drive the piercing needle to pierce the cylinder when the trigger assembly is operated and the cylinder is received in the receiving space;

wherein the piercing needle is configured to retract from the cylinder when the trigger assembly is released after being operated.

19. The gas cylinder piercing mechanism of claim 18, wherein:

the piercing needle is a triangular column movably disposed in the expansion channel and defines an internal gas passage configured to direct the compressed gas from the cylinder into the expansion channel such that the compressed gas flows to the gas supply channel when the piercing needle pierces the cylinder.

* * * * *